US008955288B1

(12) United States Patent
Snyder

(10) Patent No.: US 8,955,288 B1
(45) Date of Patent: Feb. 17, 2015

(54) LOW PROFILE ADJUSTABLE LIFT BRACKET

(71) Applicant: Timothy Snyder, Glastonbury, CT (US)

(72) Inventor: Timothy Snyder, Glastonbury, CT (US)

( * ) Notice: Subject to any disclaimer, the term of this patent is extended or adjusted under 35 U.S.C. 154(b) by 0 days.

(21) Appl. No.: 14/228,361

(22) Filed: Mar. 28, 2014

Related U.S. Application Data

(60) Provisional application No. 61/819,723, filed on May 6, 2013.

(51) Int. Cl.
*A47B 96/07* (2006.01)
*A47B 96/06* (2006.01)
*F16M 13/02* (2006.01)

(52) U.S. Cl.
CPC ..... *A47B 96/061* (2013.01); *F16M 13/02* (2013.01)
USPC ..... 52/745.21; 52/73; 52/126.7; 248/242

(58) Field of Classification Search
USPC ..... 52/745.21, 73, 223.1, 223.14, 126.1, 52/126.5, 126.7; 248/235, 241, 242, 248/220.21, 250, 243
See application file for complete search history.

(56) References Cited

U.S. PATENT DOCUMENTS

| | | | | | |
|---|---|---|---|---|---|
| 252,381 | A | * | 1/1882 | Hyre | 224/401 |
| 2,741,449 | A | * | 4/1956 | Heseiov | 248/243 |
| 2,772,846 | A | * | 12/1956 | Skar | 248/243 |
| 2,906,486 | A | * | 9/1959 | Bellon et al. | 248/242 |
| 2,986,246 | A | * | 5/1961 | Lester | 52/86 |
| 3,114,531 | A | * | 12/1963 | Weber | 248/242 |
| 3,233,853 | A | * | 2/1966 | Majewski | 248/74.4 |
| 3,561,714 | A | * | 2/1971 | Zurawski et al. | 248/243 |
| 3,891,132 | A | * | 6/1975 | Chandler | 224/509 |
| 3,905,572 | A | * | 9/1975 | Hikai et al. | 248/242 |
| 3,966,158 | A | * | 6/1976 | Boundy | 248/243 |
| 4,143,846 | A | | 3/1979 | Rock et al. | |
| 4,183,487 | A | | 1/1980 | Swain | |
| 4,299,367 | A | * | 11/1981 | Harlan | 248/235 |
| 4,531,698 | A | * | 7/1985 | Sharber | 248/243 |
| 4,546,973 | A | * | 10/1985 | Mouser | 473/472 |
| 4,549,712 | A | * | 10/1985 | Simon et al. | 248/224.8 |
| 4,700,916 | A | * | 10/1987 | Bastian et al. | 248/224.8 |
| 4,709,892 | A | * | 12/1987 | Gurgui | 248/250 |

(Continued)

FOREIGN PATENT DOCUMENTS

| | | |
|---|---|---|
| EP | 0 060 286 B1 | 5/1985 |
| EP | 0 835 629 B1 | 4/2002 |

OTHER PUBLICATIONS

Easy Leveling Shelf and Counter Bracket; www.brockinternational.com/page8.html.

*Primary Examiner* — Brent W Herring
(74) *Attorney, Agent, or Firm* — McCormick, Paulding & Huber, LLP

(57) ABSTRACT

A concealable cantilever support has a first leg extending from an outward end to an inward end, and near its inward end at least one adjusting hole; and a second leg orthogonal to the first leg, and integrally joined at an inward end thereof to the inward end of the first leg, inward faces of the first and second legs facing each other without intervening material. A portion of the first leg distal from the adjusting hole is restrained flat to the hidden face of the wall, the second leg protrudes from a roomward face of the wall with its outward face upward and orthogonal to the wall, a portion of the first leg adjacent the adjusting hole is free to flex away from the hidden face of the wall by actuation of an adjusting screw inserted through the adjusting hole.

3 Claims, 3 Drawing Sheets

(56) References Cited

U.S. PATENT DOCUMENTS

| | | | | | |
|---|---|---|---|---|---|
| 4,765,575 | A | * | 8/1988 | Bergl et al. | 248/250 |
| 4,777,888 | A | * | 10/1988 | Waterman et al. | 108/108 |
| 4,786,038 | A | | 11/1988 | Ammons | |
| 4,817,538 | A | * | 4/1989 | Michaelsen | 108/108 |
| 4,958,594 | A | * | 9/1990 | Swagerty | 119/400 |
| 5,076,648 | A | | 12/1991 | Makainai | |
| 5,118,060 | A | * | 6/1992 | Spronken | 248/218.4 |
| 5,695,163 | A | | 12/1997 | Tayar | |
| 5,775,656 | A | * | 7/1998 | Roberts et al. | 248/250 |
| 5,871,191 | A | * | 2/1999 | Cohn | 248/242 |
| 6,082,065 | A | * | 7/2000 | Feldpausch | 52/239 |
| 6,152,048 | A | * | 11/2000 | Vander Park | 108/50.02 |
| 6,224,127 | B1 | * | 5/2001 | Hodge | 296/26.08 |
| 8,157,230 | B2 | * | 4/2012 | Krueger et al. | 248/243 |
| 8,888,059 | B2 | * | 11/2014 | Kohberg et al. | 248/201 |
| 2002/0148935 | A1 | * | 10/2002 | Chambers | 248/231.9 |
| 2009/0256040 | A1 | | 10/2009 | Lee et al. | |
| 2010/0213333 | A1 | * | 8/2010 | Mejia et al. | 248/220.21 |
| 2011/0187247 | A1 | | 8/2011 | Carter | |
| 2014/0217041 | A1 | * | 8/2014 | Johnson et al. | 211/59.2 |

* cited by examiner

LOW PROFILE ADJUSTABLE LIFT BRACKET

CROSS REFERENCE TO RELATED APPLICATIONS

This application is a non-provisional of, and claims priority under 35 USC §119(e) to, U.S. Pat. App. 61/819,723, "LOW PROFILE ADJUSTABLE LIFT BRACKET," filed May 6, 2013.

BACKGROUND OF THE INVENTION

1. Technical Field

The invention relates to concealable brackets for supporting cantilevered overhangs of heavy counters or shelves.

2. Discussion of Art

In many kitchens, overhanging (cantilevered) countertops are desired to allow room for a person to sit with their knees under the countertop. Guidelines for installing granite countertops suggest that an overhang more than eight inches should have additional support to prevent the countertop from cracking and to prevent a cracked countertop causing bodily harm. In many cases, the support is desired to be invisible and unobtrusive so that a seated person, or a small child who chooses to walk or sit under the countertop, will not be injured by bumping into the support. It is also important that the support has sufficient contact with the overhang during installation and over the life of the kitchen to prevent the overhang cracking.

Current bracket designs consist of a material (usually wood or steel) that has a 90 deg angle and are mounted under the overhang. Brackets are either fastened to the visible surface of the wall or cabinet that supports the countertop overhang or consist of a flat piece of steel that is mounted to the top of cabinet. If a bracket is not firmly attached to the underside of the granite or the granite and/or cabinet shifts or deforms during use, it can still crack.

Exemplary conventional brackets include a two piece adjustable bracket, marketed by Brock International, as well as another two-piece adjustable bracket invented by Makainai (U.S. Pat. No. 5,076,648). However, these brackets protrude downward from the undersurface of a supported counter, into the knee- or head-space of a seated adult or a walking child. Thus, these conventional brackets fail to mitigate a known problem of potential bumps. Another known bracket is Tayar's track-mounted cantilever bracket (U.S. Pat. No. 5,695,163), which averts a risk of knee-bumps only by means of a highly visible track protruding from the wall.

FIG. 1 shows in cross-section a conventional standard bracket design 15 supporting an overhang 20 cantilevered from a wall 10. The typical bracket 15 is fabricated with a 90 degree angle and is mounted to a roomward surface of the wall 10 using several fasteners 30. The bracket 15 supports the weight of the overhang 20 with a compression strut 16, or alternatively the bracket may include a solid brace that fills the area 17 defined by the strut 16 (in which case, if made of wood, the bracket may be referred to as a "corbel").

It is known that in order to properly support the weight of the overhang 20, the fasteners 30 need to be tightened and the strut 16 needs to be sufficiently sturdy such that the bracket 15 and overhang 20 are in contact with each other and extend together in parallel from the wall 10. However, the bracket 15 necessarily deflects under the load of the overhang, which cannot be ascertained at the time the bracket is manufactured. Therefore, in many installations shims may be required at the end of bracket 15 to ensure the overhang 20 remains horizontal, or the bracket 15 needs to be adjusted vertically along the wall 10 to ensure contact with overhang 20 by changing the fastener locations. This process of aligning the bracket to the wall and overhang can take several iterations. Although the conventional bracket 15 is functional, however all the mounting features are visible and the strut 16 and material 17 can be bumped into by small children or by a seated person's knee.

SUMMARY OF THE DISCLOSURE

Generally, embodiments of the invention provide a bracket that has minimal visibility and does not protrude into knee-space, and that has an adjustable feature that allows the installer to preload a supported body at the desired level depending upon the length of overhang, weight of countertop, and the spacing of the brackets. The adjustable feature also ensures contact with the countertop for proper support and safety to prevent bodily harm.

Embodiments of the invention provide concealable cantilever supports that have a fine tunable adjustment feature to provide the necessary support for an overhang. In particular, an adjustable upward lift feature provides the flexibility to tailor the bracket force that exerted upward at each contact location depending upon the weight it is supporting and the amount of overhang that is required. The bracket is mounted in such a way to minimize the visibility of the bracket in applications where it is desired not to see the support. A specific application for this bracket is to support the overhang weight of heavy counter-tops (such as granite, quartz, etc.) while not having the bracket visible or intrusive to the region directly under the counter-top. While this is one application example, the bracket can also be used to provide support for any type of overhang where low visibility and adjustable support is desired.

A concealable cantilever support, according to embodiments of the invention, is mounted to the inside surface of a wall or cabinet and an adjustment lift feature is then engaged to precisely set a pre-load to match the weight of an overhang that the bracket will supporting. The bracket can be mounted to any wall that has access from the non-visible side or can be installed into factory made cabinets by simply notching the top surface of the cabinet wall and attaching the bracket directly to the inside of the wall.

DETAILED DESCRIPTION

Figure 1:
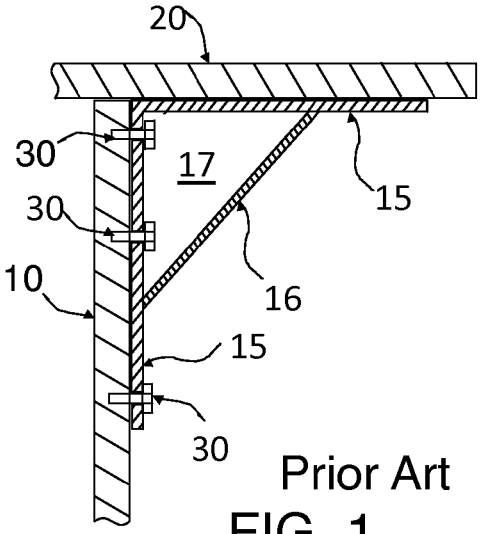
Prior Art FIG. 1
FIG. 1 shows a cross-sectional view of a conventional bracket design.
Figure 2:
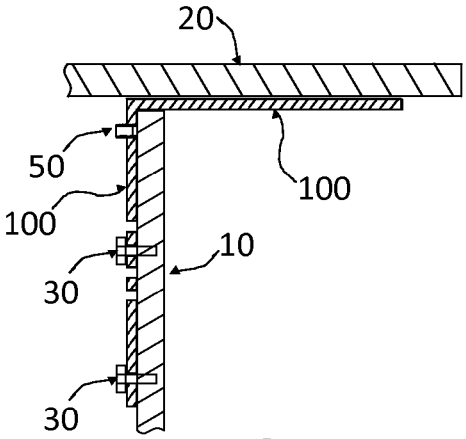
FIG. 2 shows in perspective view a low profile adjustable lift bracket according to an embodiment of the invention.

FIG. 2 shows in side section view a low profile adjustable lift bracket 100 supporting a cantilevered load 20 (e.g., a counter overhang or shelf) on a wall 10, according to an embodiment of the invention. The lift bracket 100 is mounted to the wall by fasteners 30, and includes one or more set screws 50 for adjusting a preload of the bracket as further discussed below.

Figure 3:
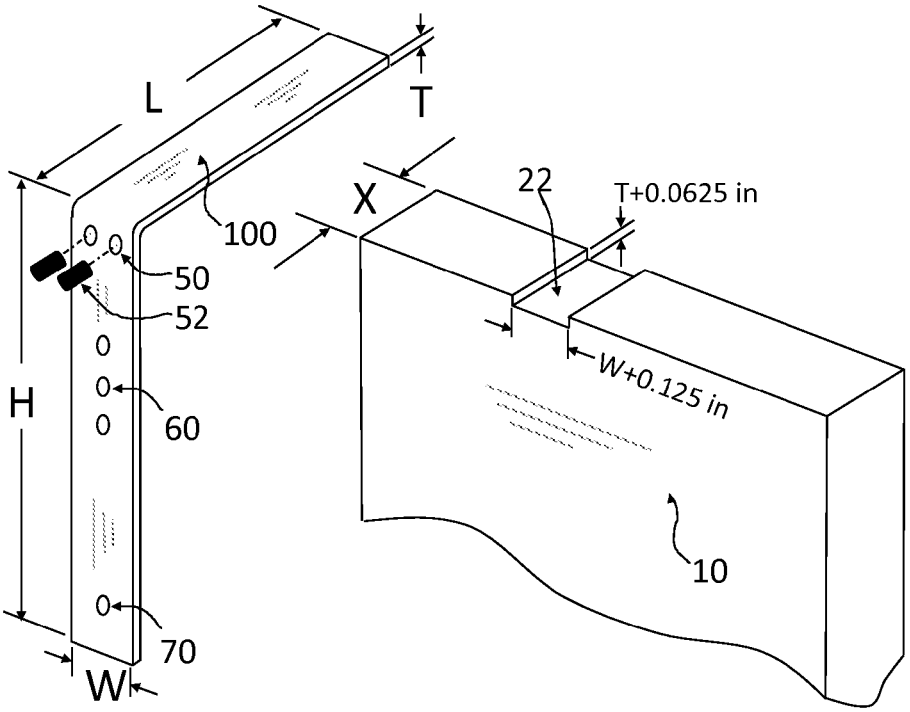
FIG. 3 shows in cross-section how a low profile adjustable lift bracket is mounted to a wall according to an embodiment of the invention.

FIG. 3 shows in perspective view the Low Profile Adjustable Lift Bracket 100, next to the support wall 10. The bracket 100 has a first leg of height H, a second leg of length L, a width W and a thickness T. The thickness T is a function of the material that is used for the bracket and of the overhang 20 weight supported along the length L.

Preferably, the inventive bracket 100 is fabricated from sheet steel for supporting granite countertops that weigh about 100 kilograms per square meter (20 pounds per square inch). The thickness T is nominally 4.8 millimeters (0.1875 inches) for a 0.3 meter (1 foot) overhang. The length L ideal for this overhang is 0.3 meters (1 foot), assuming the wall 10 has a thickness X of 101.6 millimeters (4 inches). The bracket length L should be adjusted smaller or larger than 0.3 meters by the same amount that the wall thickness X is smaller or larger than 101.6 millimeters. Additional bracket length L and bracket thickness T is required if the overhang 20 exceeds 0.5 meters (1.7 feet). The bracket height H should be approximately 0.3 meters (1 foot) and the bracket width W should be about 50 millimeters (2 inches) for all countertop overhang applications. Knowing these bracket dimensions, a notch 22 is cut into a horizontal member of the wall 10, e.g., a top plate or a header. The notch 22 has a width W+(0.125 inches) and depth T+(0.0625 inches) greater than those of the bracket 100. The additional width and depth of the notch 22 are important to ensure that there is some room in the W direction to adjust the bracket, and that the bracket supports the overhang at the end of the bracket as further discussed below.

According to embodiments of the invention, the exemplary bracket 100 is mounted to the wall 10 with the inward surface of the bracket's first leg contacting a hidden surface of the wall. An outward portion of the bracket's first leg is fixed flat against the concealed surface of the wall, while an inward portion of the first leg (nearer to the joint of the first and second legs) is free to flex away from the wall. Meanwhile, the outward end of the bracket's second leg extends through the notch 22 to project beyond a roomward surface of the wall. For example, as shown in FIG. 3, the exemplary bracket 100 includes within a lower or outward portion of its vertical first leg a hole 70, which preferably has a hole size of at least 9.5 millimeters (0.37 inches). The hole 70 is disposed at least about 25 millimeters (1 inch) from the end of the bracket 100. Between the hole 70 and the corner formed between the first and second legs of the bracket 100, at least two additional holes 60 are drilled with hole sizes of at least about 9.5 millimeters (0.37 inches), spaced approximately every 25 millimeters (1 inch) along the middle segment of bracket height H. Both the hole 70 and the holes 60 can be countersunk so that wood screws 30, to be inserted through the holes, will be flush with the bracket surface visible in FIG. 2. Additionally, about 12 millimeters (0.5 inches) below the inside surface of the horizontal or second leg of the bracket 100 (see dimension A in FIG. 4), two holes 50 are drilled and tapped with M-8 threading. The holes 50 are located approximately 25 millimeters (1 inch) apart for accepting set screws 52 each having a length of at least about 13 millimeters (0.5 inches) and preferably no more than 30 millimeters (1.2 inches).

Figure 6:
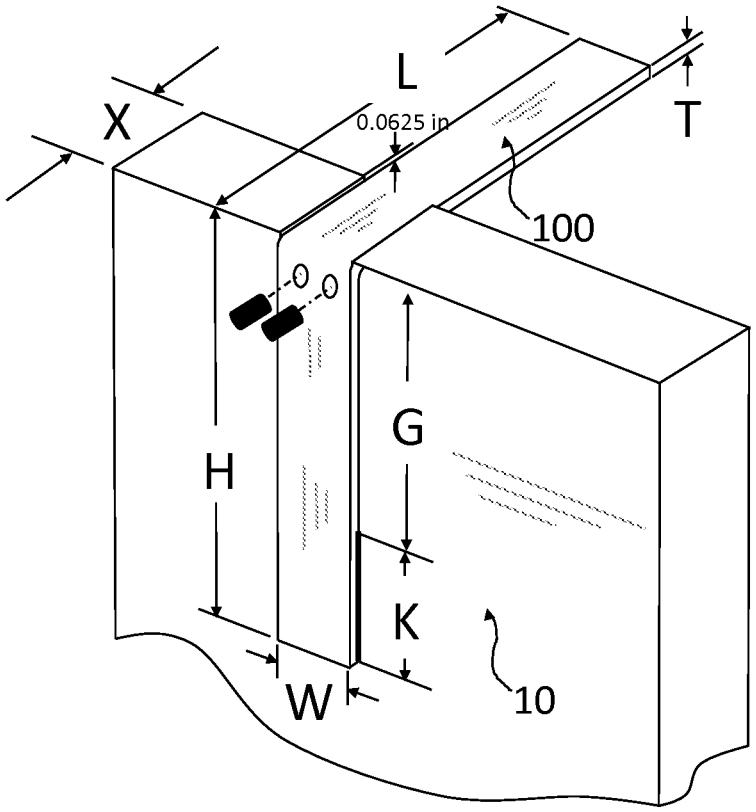
FIG. 6 shows in perspective a low profile adjustable lift bracket integrally attached to a cabinet wall, according to another embodiment of the invention.

Thus, threaded fasteners provide one mode for attaching the bracket 100 to the wall 10. Another option is to use construction adhesive for attaching the bracket to the wall. Another option is to clamp the bracket to the wall using either metal clamping plates, or a wooden clamp bar. Yet another option could be use of wood rivets. All these options presume the cabinet wall is built of wood; however, cabinets also can be constructed of metal or plastic, and in such cabinetry (as shown in FIG. 6), welding, friction welding, or integral forming may be viable alternative modes of attaching the bracket 100 to the wall 10. In any embodiment, it is important that the inward portion of the first leg (including the corner formed by the first leg and the second leg, and the adjusting hole(s) 50), should be free along a length G (FIGS. 4 and 6) to deflect away from the concealed surface of the wall according to adjustment of the adjusting screw(s) 52.

The exemplary embodiment presumes that the adjusting holes 50 per se provide threaded means for adjustably receiving the adjusting screws 52. However, in another arrangement, the adjusting holes may be plain clearance holes and the inward surface of the first leg may be indented at the adjusting holes to capture or hold discrete threaded means (e.g., nuts) for adjustably receiving the adjusting screw.

Figure 4:
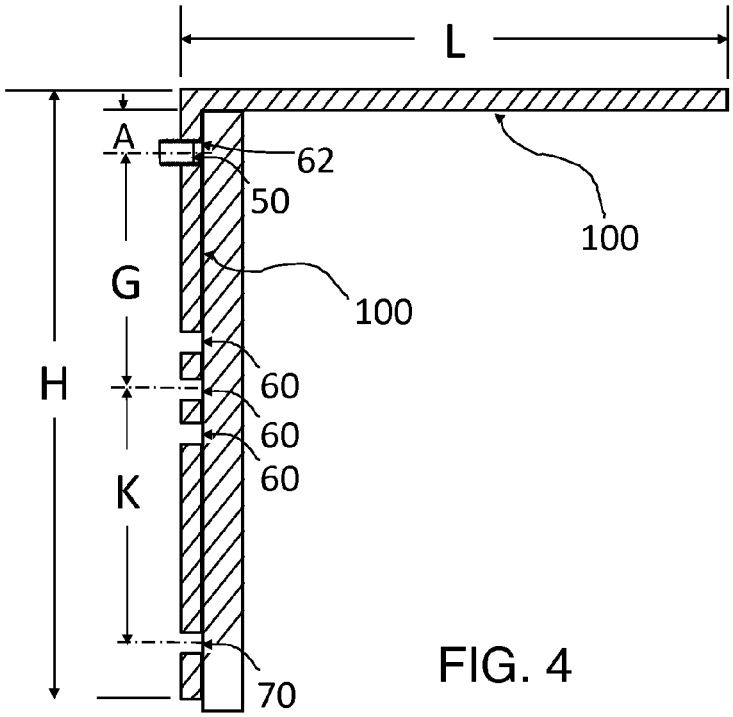
FIG. 4 shows in cross-section key dimensions of the low profile adjustable lift bracket shown in FIG. 3.

For example, FIG. 4 shows a detailed cross section of the concealable cantilever support 100. The bracket is secured to the wall 10 (see FIG. 2) with a first fastener 30 in hole 70 and a second fastener 30 in one of the four holes 60. The inward segment of the first leg, above the second fastener, has a length G. The nominal placement of the second fastener is to have dimensions G and K equal. The second fastener can also be placed in locations that make G not equal to K, if there is an obstruction at the location where G=K or if the bracket thickness is larger or smaller than the nominal thickness recommended. The bracket 100 may be secured to a vertical stud of the wall, or to an adequately-braced cripple or header.

Figure 5:
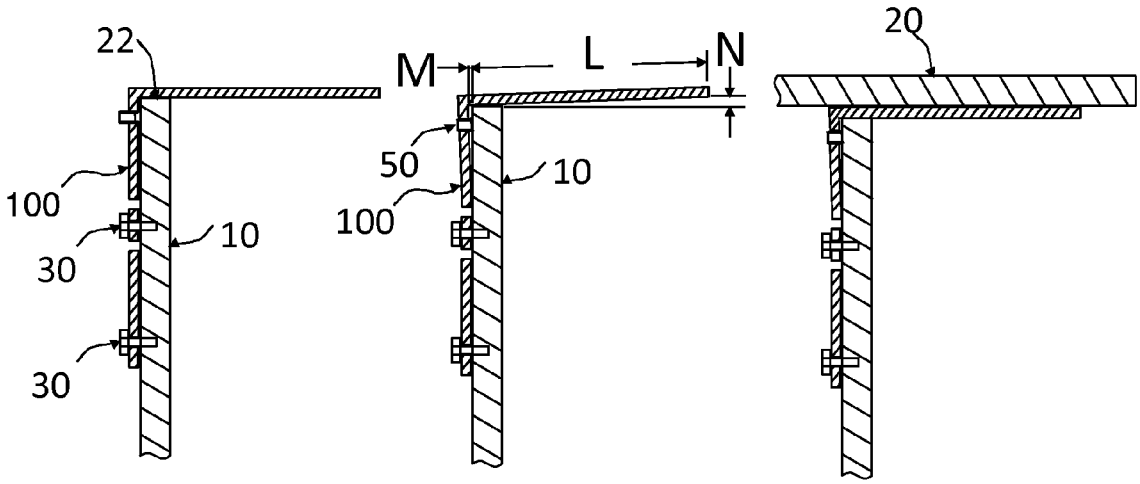
FIG. 5 shows in cross-section steps for an adjustment of the lift bracket shown in FIGS. 3-4.

FIG. 5 shows a sequence of cross-sections to explain how the adjustable lift feature is set properly to support overhang 20. The left cross section shows the Concealable cantilever support 100 attached to wall 10 using two fasteners 30 such that the bracket fits into notch 22 and is about 0.0625 inches from the top of wall 10. The center cross-section shows what happens when the set screws are evenly engaged to create a gap M, thereby deflecting the height H and causing the length L of the bracket 100 to raise vertically a distance N. Because of the location of the set screw 50 and the bracket length L, small changes to gap M caused by tightening the set screws, allow for a precise control of vertical rise N and the resulting spring force that the bracket applies to the overhang when deflected back to horizontal. There is a direct relationship of the adjustment of set screw 50 to the amount of force required to return N to zero. This relationship is used to properly set the adjustment feature on bracket to provide the proper support for countertop overhang.

The amount of weight required to return N to zero represents the amount of pre-load or lift that the adjustable bracket is applying to support overhang 20. Table 1, below, provides set screw guidelines for a typical counter-top application based upon the bracket design described above, with distance G=135 mm (5.3 inches).

TABLE 1

Number of Set Screw Turns After Bracket End is Level With Cabinet Top

| Counter Weight | | Bracket Length L (inches) | | | | | |
|---|---|---|---|---|---|---|---|
| (lb/sq ft) | Counter Material | 6 | 8 | 10 | 12 | 14 | 16 |
| 18 | Granite 1¼" thick | 2 | 2.5 | 3 | 3.5 | 4 | 4.5 |
| 12 | Granite ¾" thick | 1.3 | 1.7 | 2 | 2.3 | 2.7 | 3 |
| 6 | Resin composite | 0.7 | 0.8 | 1 | 1.2 | 1.3 | 1.5 |

Once the bracket has been attached to the wall, the set screws are adjusted so that N=zero. Additional set screw turns are then made following Table 1 based upon a calibration of the upward force for the corresponding set screw rotations.

The wall 10 may require reinforcement depending on its original thickness and on the weight of the cantilever load. Standard cabinetry has a typical wall thickness of about 13 mm (½ inch) hardwood. However, a thickness of 19 mm (¾ inch) standard pine is expected adequate to support any load listed in the table above. Thus, if the bracket 100 is installed into an existing wall, then a 2×4 brace fastened between the wall studs by angle brackets should suffice to support the bracket. On the other hand, if the bracket 100 is installed into an existing cabinet with a thickness less than 19 mm (¾ inch), then it is recommended that a ½" to ¾" piece of plywood is added to the inside surface that extends from the floor to to top of the cabinet for adequate support of the bracket. Another option is to build "granite ready" cabinetry with a roomward wall or walls of at least 18 mm (¾ inch) thickness, which is greater than the industry standard of about 13 mm (½ inch). "Granite ready" cabinetry also can have at least one roomward wall pre-notched with a series of notches 22 at spacing sufficient to support the heaviest expected counter overhang. For example, notches 22 can be spaced at most about 0.7 m (28 inches) apart, but no closer than 0.3 m (12 inches). More preferably, notches 22 can be spaced at about 0.5 m (20 inches) apart. This latter spacing is considered optimal for standard granite thickness countertop seating overhangs of about 0.3 m (12 inch).

As described with specific application to granite countertops, the concealable cantilever support provides features that uniformly support an overhang, directing the weight of the overhang to the top and inner surface of a supporting wall, while hiding the bracket mount and fasteners behind the wall. It should be understood that this bracket could be applied to other applications that require support and hence the method of installation or attachment may differ depending upon the specific need.

Although exemplary embodiments of the invention have been described with reference to attached drawings, those skilled in the art will apprehend various changes in form and detail consistent with the scope of the invention as defined by the appended claims.

What is claimed is:

1. A method for supporting a load cantilevered from a wall, said method comprising:

mounting a bracket to a first surface of said wall, with a lower end of said bracket fastened to said first surface, an upper leg of said bracket protruding from said first surface to beyond an opposite second surface of said wall, and an adjusting screw of said bracket contacting said first surface at a location between said lower end and said upper leg;

turning the adjusting screw of the bracket to press against the first surface of said wall, in order to upwardly deflect the upper leg of the bracket, thereby raising the outward end of the upper leg above a horizontal plane; and placing the load onto the upper leg of the bracket.

2. The method as claimed in claim 1, wherein the adjusting screw is turned to raise the outward end of the upper leg such that placing the load deflects the upper leg downward to be in a substantially horizontal plane.

3. The method as claimed in claim 1, wherein the adjusting screw is turned to raise the outward end of the upper leg such that placing the load does not deflect the upper leg below the horizontal plane.

* * * * *